US009050503B2

(12) United States Patent
Haley

(10) Patent No.: US 9,050,503 B2
(45) Date of Patent: Jun. 9, 2015

(54) GOLF UTILITY TOOL

(71) Applicant: Paul Haley, Pearl River, NY (US)

(72) Inventor: Paul Haley, Pearl River, NY (US)

( * ) Notice: Subject to any disclaimer, the term of this patent is extended or adjusted under 35 U.S.C. 154(b) by 84 days.

(21) Appl. No.: 13/900,591

(22) Filed: May 23, 2013

(65) Prior Publication Data

US 2014/0349783 A1 Nov. 27, 2014

(51) Int. Cl.
*A63B 57/00* (2006.01)

(52) U.S. Cl.
CPC ..... *A63B 57/0075* (2013.01); *A63B 57/0068* (2013.01)

(58) Field of Classification Search
CPC ..... A63B 57/0068; A63B 57/0075
USPC ..... 473/282, 285, 286, 404, 407, 408
See application file for complete search history.

(56) References Cited

U.S. PATENT DOCUMENTS

| | | | | | |
|---|---|---|---|---|---|
| 4,974,842 | A * | 12/1990 | Widman | 473/406 |
| 5,226,647 | A * | 7/1993 | Notarmuzi | 473/284 |
| 5,372,362 | A * | 12/1994 | Barker | 473/391 |
| 5,437,449 | A * | 8/1995 | Zink | 473/286 |
| 5,842,481 | A * | 12/1998 | King | 131/187 |
| 6,058,691 | A * | 5/2000 | Greeves | 56/400.19 |
| 6,283,875 | B1 * | 9/2001 | Jones | 473/282 |
| 6,565,458 | B1 * | 5/2003 | Cameron | 473/408 |
| 6,893,357 | B1 * | 5/2005 | Bennett | 473/282 |
| 6,997,824 | B2 * | 2/2006 | Cranman | 473/408 |
| 7,771,287 | B2 * | 8/2010 | Staszak | 473/282 |
| 2005/0288122 | A1 * | 12/2005 | Pare | 473/282 |
| 2011/0000946 | A1 * | 1/2011 | Stretcher | 224/584 |

* cited by examiner

*Primary Examiner* — Stephen Blau

(57) ABSTRACT

A golf utility tool that may be attachable to a golf club. The golf utility tool may include a clip that may be used to clip to a putter. The golf utility tool may further include a divot tool prong and a ball marker that is removably attached. The golf utility tool may further include a loop cutout for carrying other devices, such as a towel.

15 Claims, 4 Drawing Sheets

GOLF UTILITY TOOL

BACKGROUND OF THE INVENTION

The present invention relates to a golf utility tool and, more particularly, to a golf utility tool that may attach to a golf club.

Golf is a precision club and ball sport in which competing players (or golfers) use many types of clubs to hit balls into a series of holes on a course using the fewest number of strokes. Golf is defined, in the rules of golf, as playing a ball with a club from the teeing ground into the hole by a stroke or successive strokes in accordance with the Rules.

Typically during the game of golf, accessories are needed. Such accessories may include an accessory to clean the ball, fix divots, mark the ball on a green, and the like. However, many of the currently used accessories require the golfer to carry a particular device in his or her pocket. In particular, if the golfer is carrying around a cloth to clean the ball, the golfer may place the cloth in their pocket or attach the cloth to their clothing, which may be uncomfortable if the cloth is damp.

In cases where the device is fastened to the golf cart or bag, the golfer has to remember to carry the tools to the green. If the golfer forgets any tools, the golfer may have to return to the golf cart or bag to fetch the tool needed at that moment, borrow the tool from one of his/her golf partners, or not use the desired accessory. This is inconvenient and wastes time. Further, each accessory is separate and easy to lose.

As can be seen, there is a need for an easily accessible multi-purpose golf utility tool.

SUMMARY OF THE INVENTION

In one aspect of the present invention, a golf utility tool comprises: a clip comprising a first wing and a second wing, wherein the first wing comprises a first handle portion and a first clip portion and the second wing comprises a second handle portion and a second clip portion, and wherein the first clip portion and the second clip portion is biased in a closed position; and a divot prong comprising a first prong and a second prong, wherein the first prong and the second prong are adjacent to one another, wherein the divot prong is attached to and extending from the clip.

In another aspect of the present invention, a golf tool device comprises: a clip comprising a first wing and a second wing, wherein the first wing comprises a first handle portion and a first clip portion and the second wing comprises a second handle portion and a second clip portion, and wherein the first clip portion and the second clip portion is biased in a closed position; and at least one ball marker removably attached to the clip.

These and other features, aspects and advantages of the present invention will become better understood with reference to the following drawings, description and claims.

DETAILED DESCRIPTION OF THE INVENTION

Figure 1:
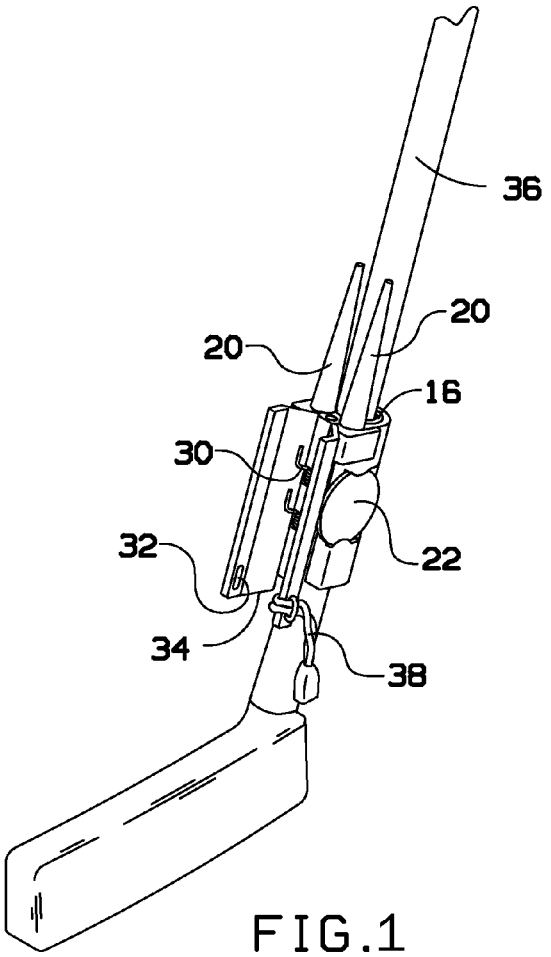
FIG. 1 is a perspective view of the present invention attached to an exemplary putter.
Figure 2:
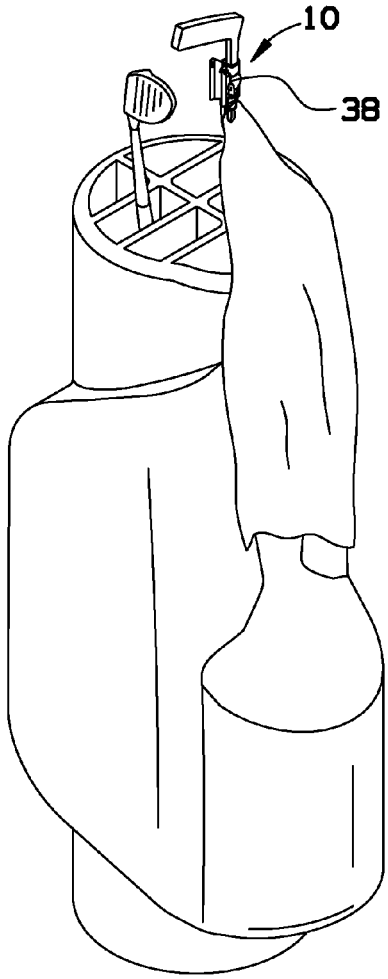
FIG. 2 is a perspective view of the present invention of FIG. 1 with the exemplary putter inside an exemplary golf bag.
Figure 3:
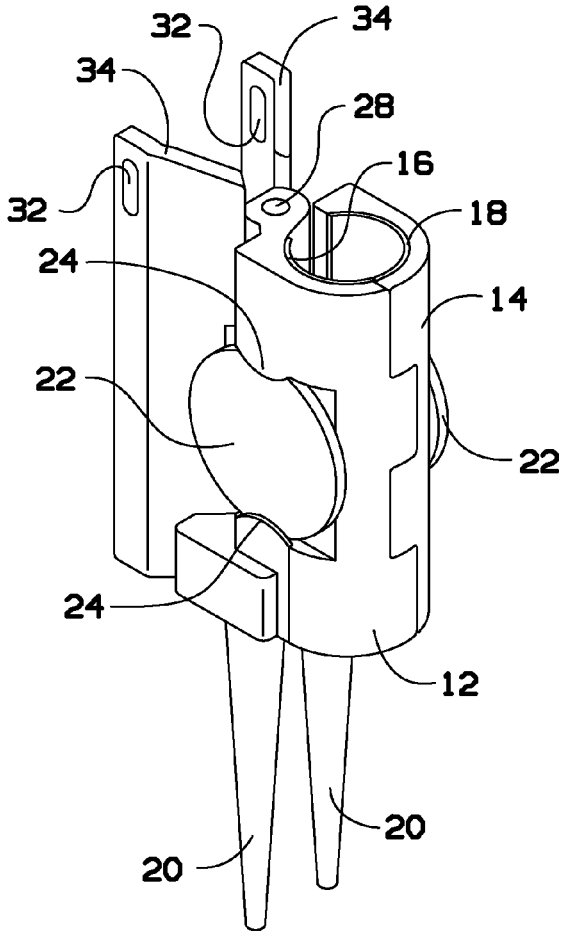
FIG. 3 is a front perspective view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a golf utility tool that may be attachable to a golf club. The golf utility tool may include a clip that may be used to clip to a putter or other club. The golf utility tool may further include a divot tool prong and a ball marker that is removably attached. The golf utility tool may further include a loop cutout for attaching a towel or other ancillary item.

The present invention may include a golf utility device that may provide ready and convenient access to multiple golf tools when needed while playing golf. The present invention may be easily attached and detached to and from a golf club shaft. The present invention may include at least one ball marker, a golf ball cleaning cloth, and a divot repair tool.

In certain embodiments, the present invention may be attached to the putter, which is commonly brought to the green for play. However, the present invention may be clipped to any club, attached to a golf bag legs, rings or clipped on the bag edge. The tools needed are generally used on the green, and the present invention provides the tools needed. The present invention may be easily detached and used or shared with other golfers.

In certain embodiments, there may be at least one ball marker attached to the device. For example, there may be two ball markers. The ball markers may be used to mark one's own ball and to mark that of another golfer, in case they do not have a marker in the immediate area. When detaching the device, prior to putting, the golfer may leave the device on the ground or attach the device to the golfer's belt loop, pocket or other article of clothing. In additional, a user may pin the device to the ground and the user's putter or other club such as the golfer's pitching wedge may rest on the device. This may prevent the club grip from resting on damp or dirty greens. When putting is complete the present invention may be attached back on the club shaft and hence the accessories are all readily accessible again when the club is used on the next green.

Referring to FIGS. 1 through 8, the present invention may be a golf utility tool 10 which may be a clip. The clip may include a first wing 12 and a second wing 14. The first wing 12 may include a first handle portion and a first clip portion. The second wing 14 may mirror the first wing 12 and may also include a second handle portion and a second clip portion. The first wing 12 and the second wing 14 may include through holes that align with one another. A pin 28 may be secured through the through holes and thereby connecting the first wing 12 and the second wing 14. At least one spring 30 may be placed in between the first wing 12 and the second wing 14 for biasing the first clip portion and the second clip portion in a closed position.

In certain embodiments, the golf utility tool 10 may include add-ons used on the golf course. As illustrated in the Figures, the present invention may include a divot prong 20. The divot prong may include a first prong and a second prong. The first and second prong may be adjacent to one another. The divot prong 20 may extend from the bottom of the clip. For example, the first prong may extend from the bottom of the first wing 12 and the second prong may extend from the bottom of the second wing 14.

The present invention may further include at least one ball marker 22 removably attached to the golf utility tool 10. For example, the present invention may include a first ball marker 22 removably attached to the first wing 12 and a second ball marker 22 removably attached to the second wing 14. In certain embodiments, the first wing 12 and the second wing 14 may include a magnet 26 that the ball markers 22 may be secured to. In certain embodiments, the first wing 12 and the second wing 14 may include a ball marker retainer 24 including a first ridge and a second ridge. The ball marker 22 may be housed in between the first ridge and the second ridge and may thereby be removably connected to the ball marker retainer 24.

The handle portions of the first wing 12 and the second wing 14 may further include accessories. As illustrated in FIG. 1, the handle portions may include a loop cutout 32 which may be used to attach a towel. The loop cutout 32 may secure a towel attachment loop 38. The towel attachment loop 38 may secure a towel that may be used to clean a golf ball. Two cloths may be attached, one on each wing 12, 14 allowing for any combination of damp, smooth or rough cloths for cleaning dry or damp earth from the golf ball and shining/smoothing the golf ball surface.

In certain embodiments, the top of the handle portions may include a v-groove surface 34. The v-groove surface 34 may be shaped like a V and may be used to support the golf club to prevent the golf club handle from getting dirty or for supporting a cigar. A user may drive the divot prongs 20 into the ground and rest their golf club or cigar on the v-groove surface 34.

Figure 4:
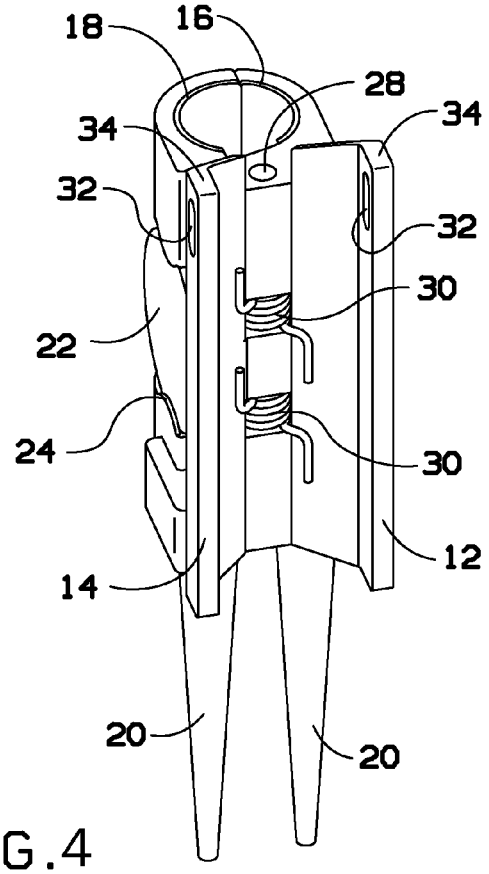
FIG. 4 is a rear perspective view of the present invention.
Figure 5:
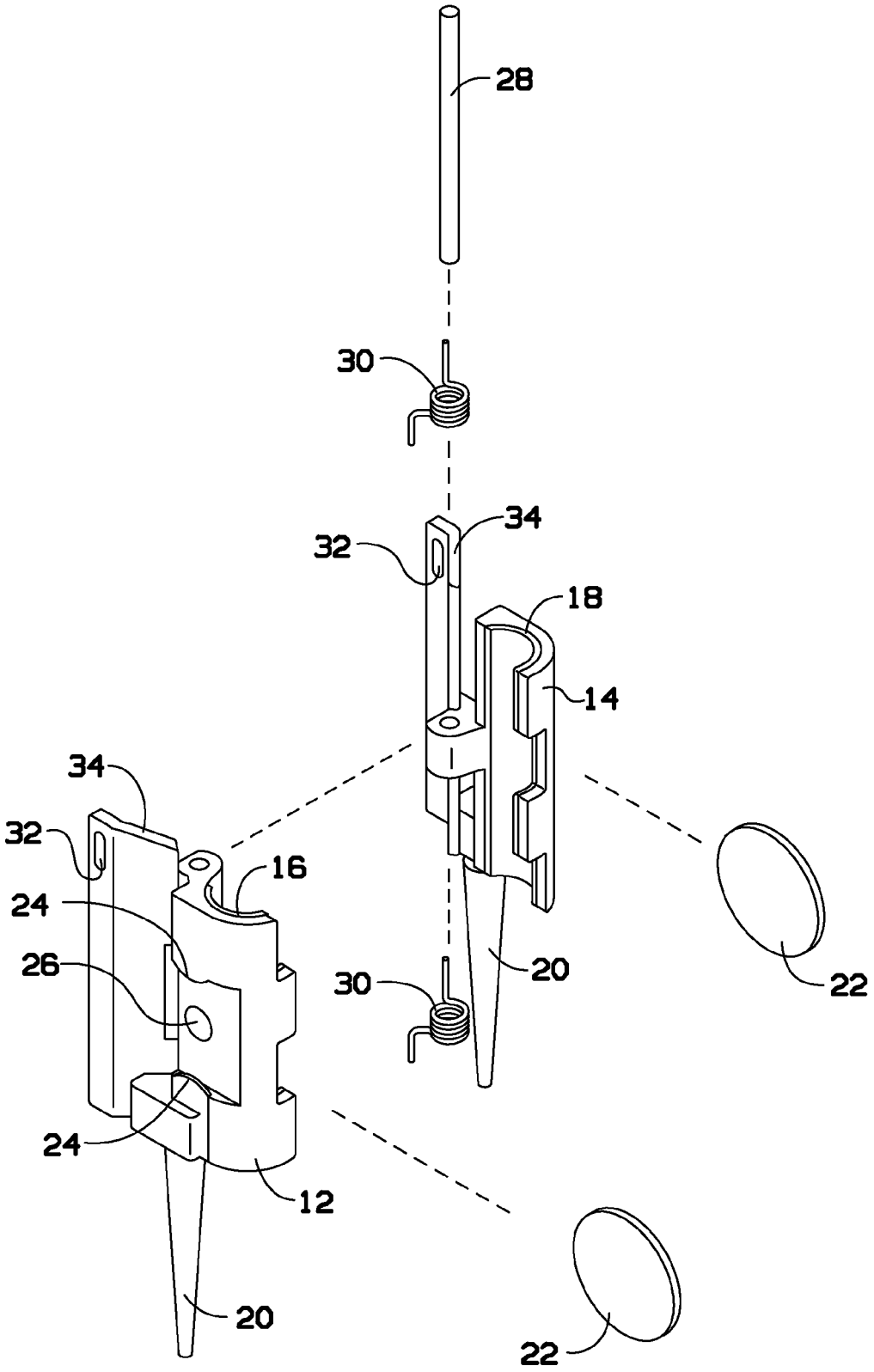
FIG. 5 is an exploded view of the present invention.
Figure 6:
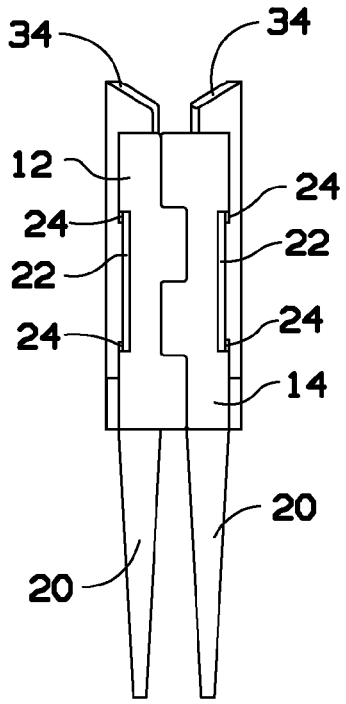
FIG. 6 is a front view of the present invention.
Figure 7:
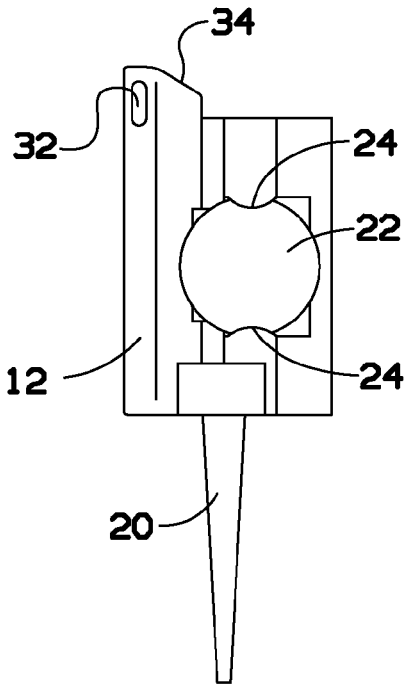
FIG. 7 is a right side view of the present invention.
Figure 8:
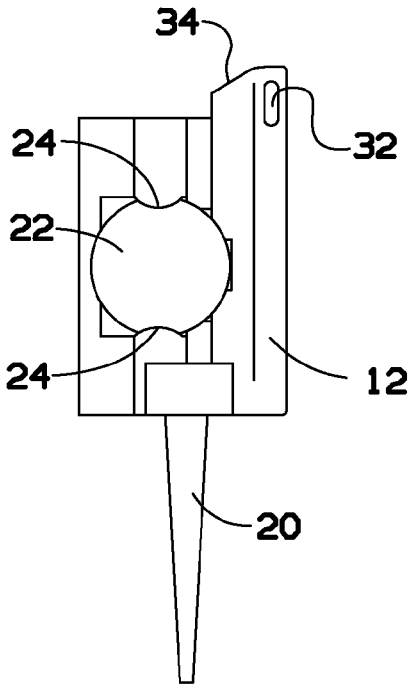
FIG. 8 is a left side view of the present invention.

In certain embodiments, the present invention may be configured to be clipped onto a golf club, such as a putter 36. When the golf utility tool 10 is needed, the user may easily unclip the tool 10 from the putter 36. In certain embodiments, to prevent damage to the putter 38, the present invention may include foam padding. As illustrated in FIG. 4, a first foam padding 16 may line the inside of the first clip portion and a second foam padding 18 may line the insider of the second clip portion.

A method of using the present invention may include the following. The golf utility tool may be attached to the golfer's club shaft at the beginning of the round of golf and placed in the user's golf bag. The golf utility tool is primarily intended for attachment to the putter but during inclement weather where clean and place rules apply, the utility may be attached to a fairway iron. During play, the golfer takes his or her putter from his/her bag and steps onto the green to begin the putting phase of playing a hole. When on the green the golfer may repair a ball mark created by his/her or another golfer's ball, mark his/her or another golfer's ball using a golf ball marker before picking up the ball to either clean the ball or provide clear access to the hole for another golfer or to avoid being hit by another golfer's putting effort. Once the ball is lifted off the green, the golfer may clean the ball. Before cleaning the ball, the golfer may rest his club without getting the grip damp or dirty by using the device's v-groove surface. If not pinned to the ground, the golf utility tool may be clipped to the golfer's belt straps, pants pocket or other piece of the golfers clothing. To replace a ball marker with the golf ball the golfer picks up the marker and reattaches it to the golf utility tool. When putting is finished, the golf utility tool may then reattach to the putter shaft and the club may be placed in the golfer's golf bag. Play then moves onto the next hole where the golf utility tool may again be readily available for use.

It should be understood, of course, that the foregoing relates to exemplary embodiments of the invention and that modifications may be made without departing from the spirit and scope of the invention as set forth in the following claims.

What is claimed is:

1. A golf utility tool comprising:

a clip comprising a first wing and a second wing, wherein the first wing comprises a first handle portion and a first clip portion and the second wing comprises a second handle portion and a second clip portion, and wherein the first clip portion and the second clip portion is biased in a closed position by a spring; and a divot prong comprising a first prong and a second prong, wherein the first prong and the second prong are parallel relative to one another, wherein the first prong and the second prong are attached to and extend from at least one of a bottom of the first wing and the second wing.

2. The golf tool device of claim 1, wherein the first prong is extending from a bottom of the first wing of the clip, and the second prong is extending from a bottom of the second wing of the clip.

3. The golf tool device of claim 1, wherein at least one of the first handle portion and the second handle portion of the clip comprises a loop cutout portion configured for attaching a towel or other ancillary product to the clip.

4. The golf tool device of claim 1, further comprising at least one ball marker removably attached to the clip.

5. The golf tool device of claim 4, wherein the at least one ball marker is a first ball marker and a second ball marker.

6. The golf tool device of claim 4, further comprising a magnet within at least one of the first clip portion and the second clip portion of the clip, wherein the at least one ball marker is removably attached to the magnet.

7. The golf tool device of claim 4, further comprising a first ridge and a second ridge formed on at least one of the first clip portion and the second clip portion of the clip, wherein the at least one ball marker is housed in between the first ridge and the second ridge and is thereby removably attached to the clip by the first ridge and the second ridge.

8. The golf device of claim 1, further comprising a first foam padding attached to an inside surface of the first clip portion and a second foam padding attached to an inside surface of the second clip portion.

9. The golf device of claim 1, wherein a top of the first handle portion and the second handle portion form a v-groove surface.

10. A golf tool device comprising:

a clip comprising a first wing and a second wing, wherein the first wing comprises a first handle portion and a first clip portion and the second wing comprises a second handle portion and a second clip portion, and wherein the first clip portion and the second clip portion is biased in a closed position;

a first ridge and a second ridge formed on at least one of the first clip portion and the second clip portion of the clip;

at least one ball marker housed in between the first ridge and the second ridge and is thereby removably attached to the clip by the first ridge and the second ridge; and a v-groove surface formed on a top of the first handle portion and the second handle portion.

11. The golf tool device of claim 10, wherein at least one of the first handle portion and the second handle portion of the clip comprises a loop cutout portion configured for attaching a towel or other ancillary product to the clip.

12. The golf tool device of claim 10, wherein the at least one ball marker is a first ball marker and a second ball marker.

13. The golf tool device of claim 10, further comprising a magnet within at least one of the first clip portion and the second clip portion of the clip, wherein the at least one ball marker is removably attached to the magnet.

14. The golf device of claim 10, further comprising a first foam padding attached to an inside surface of the first clip portion and a second foam padding attached to an inside surface of the second clip portion.

15. A golf utility tool comprising:

a clip comprising a first wing and a second wing, wherein the first wing comprises a first handle portion and a first clip portion and the second wing comprises a second handle portion and a second clip portion, and wherein the first clip portion and the second clip portion is biased in a closed position by a spring; and a divot prong comprising a first prong and a second prong, wherein the first prong and the second prong are adjacent to one another, wherein the first prong is extending from a bottom of the first wing of the clip, and the second prong is extending from a bottom of the second wing of the clip.

* * * * *